US006315394B1

(12) United States Patent
Fujii

(10) Patent No.: US 6,315,394 B1
(45) Date of Patent: Nov. 13, 2001

(54) METHOD OF MANUFACTURING A SILICON SUBSTRATE WITH A RECESS, AN INK JET HEAD MANUFACTURING METHOD, A SILICON SUBSTRATE WITH A RECESS, AND AN INK JET HEAD

(75) Inventor: Masahiro Fujii, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 09/239,396

(22) Filed: Jan. 28, 1999

(30) Foreign Application Priority Data

Jan. 28, 1998 (JP) ..... 10-015322

(51) Int. Cl.[7] ..... B41J 2/04
(52) U.S. Cl. ..... 347/54
(58) Field of Search ..... 347/54, 93, 20, 347/40, 94, 68, 69, 70, 71, 72, 50; 399/261; 361/700; 29/890.1; 310/328–330

(56) References Cited

U.S. PATENT DOCUMENTS 5,277,783 1/1994 Ohashi et al. .
5,992,978 * 11/1999 Fujii et al. ..... 347/54

FOREIGN PATENT DOCUMENTS 0 580 283 1/1994 (EP) .
58-112755 7/1983 (JP) .
3-79350 4/1991 (JP) .
4-338550 11/1992 (JP) .
6-71882 3/1994 (JP) .

* cited by examiner

*Primary Examiner*—Raquel Yvette Gordon
(74) *Attorney, Agent, or Firm*—Mark P. Watson

(57) ABSTRACT

A manufacturing method for a silicon substrate having a recess and an ink jet head, as well as the silicon substrate and the ink jet head. A silicon substrate having recesses is manufactured by a method providing for increased precision, resolution, and reduced size by wet oxidation of the silicon substrate to form a thermal oxidation film as the mask used for recess etching, etching recesses into the silicon substrate using as the mask the thermal oxidation film formed by wet oxidation, removing the thermal oxidation film formed in the masking process after etching is completed, then forming a protective film on the silicon substrate by dry oxidation of the substrate after removing the mask. The resulting silicon substrate can be used to manufacture an ink jet head in which the etched recesses form diaphragms and ink nozzles, the protective film provides high resistance to corrosion by ink, and reduced power consumption can be achieved.

7 Claims, 4 Drawing Sheets

METHOD OF MANUFACTURING A SILICON SUBSTRATE WITH A RECESS, AN INK JET HEAD MANUFACTURING METHOD, A SILICON SUBSTRATE WITH A RECESS, AND AN INK JET HEAD

BACKGROUND OF THE INVENTION

1. Field of the Invention

The present invention relates to a method of manufacturing a silicon substrate with a recess, a method of manufacturing an ink jet head, a silicon substrate with a recess, and an ink jet head comprising a silicon substrate in which a recess forms a diaphragm. The present invention relates more particularly to an ink jet head for use in a printer, facsimile machine, or other printing device.

2. Description of the Related Art

Ink jet heads used in printers, facsimile machines, and other types of printing devices print by ejecting ink drops onto the printing medium, and various methods have been proposed for the ink ejection mechanisms. One such method uses a heater to vaporize the ink, creating a pressure bubble whereby an ink drop is ejected. Another method applies voltage to a piezoelectric element, which is affixed to the ink chamber in which the ink is held, to expand and contract the ink chamber (increase and decrease the internal volume) and thereby cause an ink drop to be ejected. Yet another method use electrostatic force (an electrostatic actuator) to change the volume of the ink chamber in which the ink is held, and thereby eject an ink drop.

The ink jet heads used in these various methods are manufactured using precision semiconductor processing techniques. For example, an ink jet head that ejects ink drops by means of electrostatic force is achieved by forming a recess (diaphragm) in a silicon substrate, arranging an electrode opposed to the diaphragm with a specific gap therebetween, and inducing an electrostatic force between the recess (diaphragm) and electrode to displace the recess (diaphragm) and thereby change the internal pressure of the ink chamber to eject an ink drop from an ink nozzle. This recess (diaphragm) and the member on which the electrode is disposed are referred to as "opposing members."

The ink chamber is formed by bonding a second substrate of silicon, glass, or other material to the silicon substrate in which the recess (diaphragm) is formed such that the recess (diaphragm) is covered by the second substrate. The recess (diaphragm) of the first silicon substrate thus forms one wall of the ink chamber.

Precision semiconductor processing technologies are used to produce the recess (diaphragm) in such silicon substrates. That is, an etchant-resistant material (mask) is formed on the silicon substrate for shaping the recess (diaphragm), and the substrate is then etched to produce the recess (diaphragm).

Thermal oxidation of a silicon substrate produces a thermal oxidation film on the substrate surface, and this thermal oxidation film is typically used as a mask.

A protective thermal oxidation film is also typically formed on the surface of the silicon layer in which the recess (diaphragm) is formed before bonding with the opposing substrate as a means of improving wettability with the ink and preventing corrosion of the silicon by the ink.

Methods of manufacturing such ink jet heads are taught by the present inventor in Japan Unexamined Patent Application Publication (kokai) H3-79350 and H6-71882.

In general, there are two methods for forming a thermal oxidation film, wet oxidation and dry oxidation. Dry oxidation is a slower process for film formation (film formation rate), but results in a dense oxidation film of good quality. Wet oxidation produces a film that is not as dense and inferior in quality compared with the dry oxidation film, but the film formation rate is faster.

A thermal oxidation film is formed to protect the ink channel walls and diaphragm from dissolution by ink. When the film is formed by wet oxidation, the inferior quality of the resulting thermal oxidation film results in relatively poor ink resistance. The silicon substrate therefore becomes more susceptible to corrosion and dissolution by ink. This is also true when the second substrate is made from silicon and the thermal oxidation film formed thereon is achieved by wet oxidation.

The lower density of thermal oxidation films formed by wet oxidation also means that sufficient electrical isolation may not be achieved. If this method is then used to produce an electrostatically driven ink jet head, the electrostatic charge produced between the recess (diaphragm) and electrode can discharge and damage the recess (diaphragm).

The fast film growth rate of the wet oxidation process also makes it difficult to control the film thickness with high precision. Variations in film thickness therefore result, the electrostatic attraction characteristic of the recess (diaphragm) is degraded, and the electrostatic attraction force, in particular, can drop. This degradation of the electrostatic attraction characteristic can prevent ink drops from being ejected with appropriate volume, and can therefore degrade print quality.

It is possible to improve the corrosion resistance and insulation properties of the thermal oxidation film formed by wet oxidation by simply increasing the film thickness. However, when the film thickness is increased, the electrostatic force produced between opposing members drops, and electrostatic attraction drops accordingly. It is therefore difficult to reduce power consumption and device size.

It is also obviously possible to form both the protective thermal oxidation film and the thermal oxidation film used as a mask by means of a dry oxidation process. The slow film formation rate of the dry oxidation process, however, reduces the productivity of ink jet head manufacturing, and therefore leads to increased ink jet head cost.

OBJECTS OF THE INVENTION

In consideration of the above-noted problems, it is an object of the present invention to provide a manufacturing method for an ink jet head whereby the efficiency of ink jet head production and the durability of the resulting ink jet head can both be improved by selecting the oxidation method used to form a thermal oxidation film on a silicon substrate according to the purpose of the thermal oxidation film.

SUMMARY OF THE INVENTION

To achieve the above-described object, a method for manufacturing a silicon substrate with a recess according to the present invention forms a thermal oxidation film on a silicon substrate by means of wet oxidation to form a mask for recess etching in a mask formation process, etches a recess in the silicon substrate using as a mask the thermal oxidation film formed in the mask formation process, removes from the silicon substrate the thermal oxidation film formed in the mask formation process after the etching process, and then forms a protective film on the silicon substrate by means of a dry oxidation process after mask removal.

An ink jet head manufacturing method according to the present invention forms, in a mask formation process, a thermal oxidation film by means of wet oxidation on a silicon substrate as a mask for etching a diaphragm, which is used for ejecting ink from the ink jet head. An etching process then etches a diaphragm into the silicon substrate using as a mask the thermal oxidation film formed in the mask formation step. The thermal oxidation film formed in the mask formation process is then removed from the silicon substrate after the etching process in a film removing step. A protective film is then formed on the silicon substrate by dry oxidation of the silicon substrate after the film removing step. After the protective film formation step, a second substrate is bonded to the silicon substrate to form an ink chamber in which the diaphragm constitutes part of the ink chamber walls.

When the second substrate is a silicon substrate in which ink nozzles are formed as in a face ink jet head, the ink jet head manufacturing method according to the present invention also forms a thermal oxidation film on the second substrate by means of wet oxidation in a second mask formation step to form a mask for etching an ink nozzle open to the ink chamber. Ink nozzles are then etched in a second etching step using the previously formed mask. After etching, the thermal oxidation film formed by the second mask formation step is removed in a second film removing step. Finally, a protective film is formed on the second substrate in a second protective film formation step by means of dry oxidation after the second film removing step.

By thus combining wet oxidation whereby the manufacturing time can be reduced and dry oxidation whereby precision can be increased in these manufacturing methods of the present invention, a silicon substrate having recesses and high corrosion resistance can be manufactured in a short period of time. These recesses can be used to form the diaphragms and ink nozzles of an ink jet head.

Furthermore, by completely removing the thermal oxidation film used as a mask from around the recesses (diaphragms), depression of the recesses (diaphragms) by thermal oxidation for protective film formation is eliminated, and recesses (diaphragms) can be precisely manufactured.

Furthermore, when an electrostatically driven ink jet head is manufactured using the ink jet head manufacturing method of the present invention, a third substrate whereon an electrode is formed to oppose the diaphragm with a specific gap therebetween is bonded to the opposite side of the silicon substrate to which the second substrate is bonded.

Yet further, a silicon substrate having a recess according to the present invention is characterized by having a ratio of recess compliance to recess length equal to or greater than $0.64\times10^{(-19)}m^4/N$ and less than or equal to $3.3\times10^{(-19)}m^4/N$ .

Further, an ink jet head comprising a silicon substrate with a diaphragm for ejecting ink according to the present invention has an ink chamber, one wall of which is the diaphragm; an ink nozzle open to the ink chamber; an electrode disposed opposite the diaphragm with a specific gap therebetween for displacing the diaphragm by electrostatic force; and a ratio of diaphragm compliance to diaphragm length equal to or greater than $0.64\times10^{(-19)}m^4/N$ and less than or equal to $3.3\times10^{(-19)}m^4/N$ .

It is thus possible according to the present invention to provide a silicon substrate and an ink jet head in which the recess or diaphragm density is high and size can be reduced.

Other objects and attainments together with a fuller understanding of the invention will become apparent and appreciated by referring to the following description and claims taken in conjunction with the accompanying drawings.

BRIEF DESCRIPTION OF THE DRAWINGS

In the drawings, wherein like reference symbols refer to like parts.

Key to the Figures.

Figure 1:
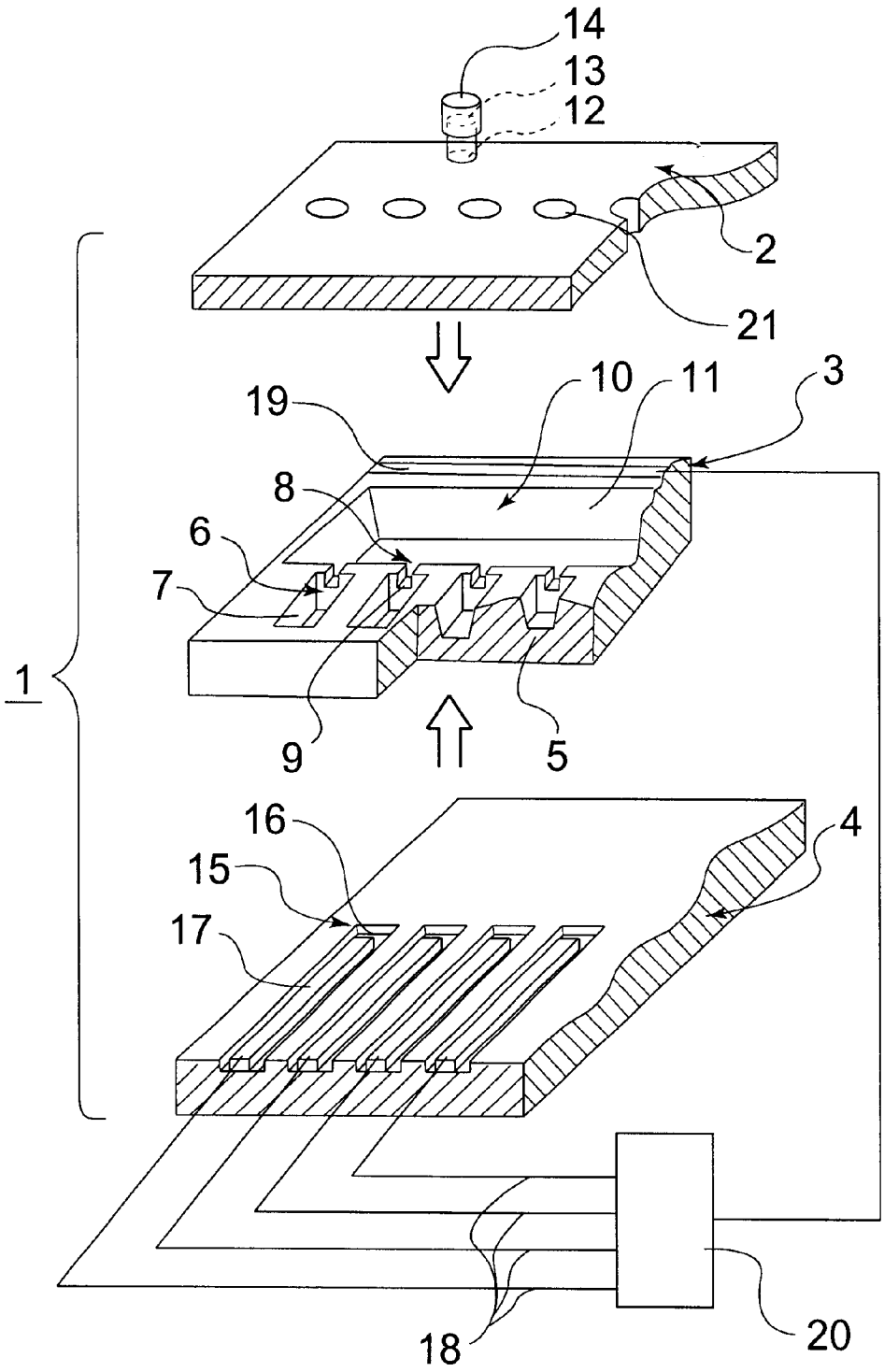
FIG. 1 is a partially exploded oblique view of an ink jet head formed by the manufacturing method of the present invention.

1 ink jet head
2 nozzle plate (second substrate)
3 cavity plate (first substrate)
4 glass substrate (third substrate)
5 diaphragm
6 ink chamber
8 ink supply opening
10 ink reservoir
12 ink supply opening
17 individual electrode
20 driver
21 ink nozzle
30 silicon substrate
31 thermal oxidation film formed by wet oxidation
32 thermal oxidation film formed by dry oxidation
35 silicon substrate
36 thermal oxidation film formed by wet oxidation
37 thermal oxidation film formed by dry oxidation

DESCRIPTION OF THE PREFERRED EMBODIMENTS

The preferred embodiments of the present invention are described below with reference to the accompanying figures. It should be noted that the preferred embodiments described below are descriptive of the present invention only and shall not limit the scope of the accompanying claims. It will therefore be obvious to one with ordinary knowledge in the related art that equivalent embodiments in which any one or all of the elements is replaced by an equivalent element can also be achieved, and such variations are also included within the scope of the present invention.

Overall Configuration

Figure 2:
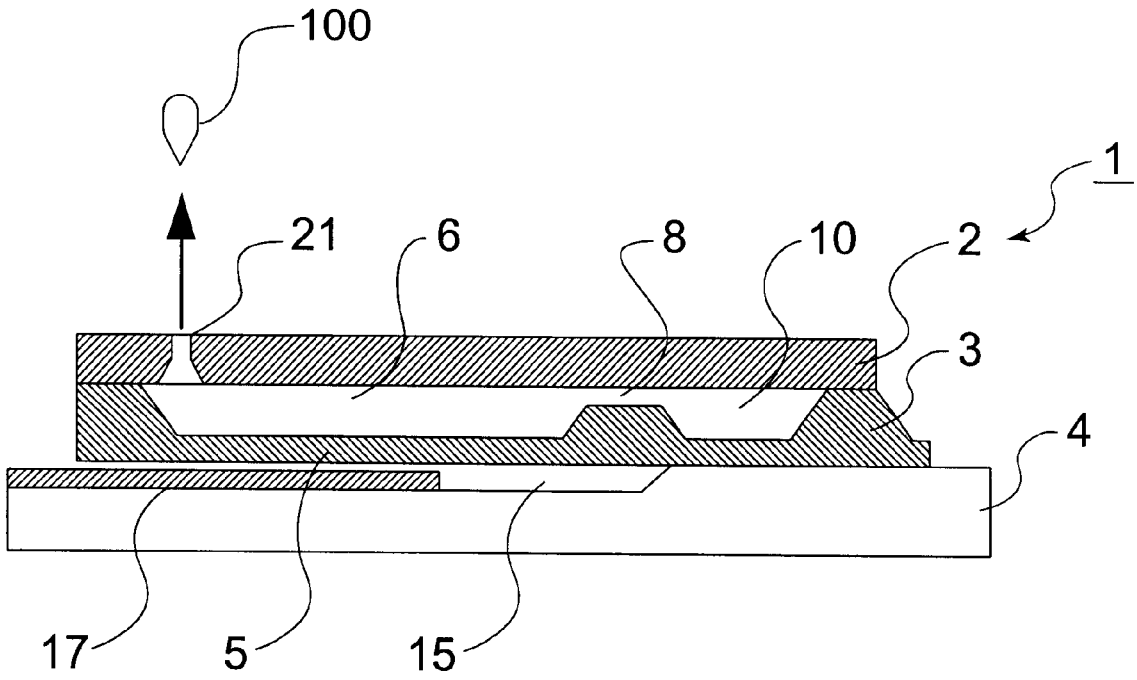
FIG. 2 is a section view of the ink jet head shown in FIG. 1.

FIG. 1 is a partially exploded oblique view showing part of an ink jet head formed by the manufacturing method of the present invention, and FIG. 2 is a partial cross section thereof. As shown in these figures, this ink jet head 1 is a face ink jet type in which ink drops are ejected from ink nozzles disposed on the substrate surface. It is also electrostatically driven. The ink jet head 1 is formed by bonding together in sequence a nozzle plate (second layer) 2, cavity plate (first layer) 3, and glass layer (third layer) 4.

The cavity plate 3 is formed in a silicon substrate in the surface of which a recess 7, channel 9, and recess 11 are formed by etching. Recess 7 becomes an ink chamber 6 of which the bottom wall functions as a diaphragm 5. Channel 9 becomes an ink supply opening 8 disposed at the back of a recess 7 as seen in the figure. Recess 11 becomes an ink reservoir 10 from which ink is supplied to each of the ink chambers 6. The bottom of the cavity plate 3 is smoothed to a mirror finish by mirror polishing.

The nozzle plate 2 bonded to the top of this cavity plate 3, that is, the surface into which the above-noted recesses are formed, is also a silicon layer. A plurality of ink nozzles 21, open to each of the ink chambers 6, is formed by etching the nozzle plate 2 in the areas thereof corresponding to the top of each ink chamber 6. An ink supply opening 12 open to the ink reservoir 10 is similarly formed in the nozzle plate 2 in the area thereof corresponding to the ink reservoir 10. This ink supply opening 12 is connected to an ink tank, not shown in the figures, by means of connector pipe 13 and tube 14.

Bonding the nozzle plate 2 and cavity plate 3 together thus forms therebetween the ink chambers 6, ink supply openings 8, and ink reservoir 10.

The glass substrate 4 is bonded to the bottom of the cavity plate 3, that is, so that the cavity plate 3 is disposed between the nozzle plate 2 and glass substrate 4. A plurality of recesses 16 that becomes vibration chambers 15 is formed in an area of the glass substrate 4 corresponding to each of the diaphragms 5. A plurality of individual electrodes 17 is disposed in the bottom of these recesses 16 opposite each diaphragm 5. Each individual electrode 17 is connected by a lead wire 18 to a driver 20. The driver 20 is connected to a common electrode 19 formed in the cavity plate 3.

The diaphragm 5 defining the bottom surface of each ink chamber 6 formed in the cavity plate 3 functions as a common electrode. When voltage is applied to the individual electrode 17 by the driver 20, the common electrode (diaphragm 5) opposing the individual electrode 17 to which voltage was applied vibrates due to the resulting electrostatic force. Vibration of the diaphragm 5 causes the pressure inside the corresponding ink chamber 6 to change, and this pressure change causes an ink drop 100 of an appropriate volume to be ejected from the ink nozzle 21. The principles of an electrostatic ink jet head are described in commonly assigned U.S. Pat. No. 5,513,431 to Ohno et al., which is incorporated herein by reference in its entirety.

For example, when a positive voltage pulse is applied to charge the surface of an individual electrode 17 to a positive potential, the bottom surface of the opposing diaphragm 5 is charged to a negative potential. The diaphragm 5 is thus attracted by this electrostatic force and deflects downward toward electrode 17. This downward deflection of the diaphragm 5 increases the volume of the ink chamber 6 and thus draws ink from the ink reservoir 10 through the ink supply opening 8 and into the ink chamber 6. When the voltage pulse applied to the individual electrode 17 is then turned off, the diaphragm 5 returns to the original position. This return movement of diaphragm 5 produces a sudden increase in the internal pressure of the ink chamber 6 and thereby causes an ink drop to be ejected from the ink nozzle 21.

Manufacturing the Cavity Plate

A method of manufacturing the cavity plate 3 is described next with reference to FIGS. 3(A)–3(F) which illustrate the steps in the cavity plate manufacturing process.

Figure 3A:
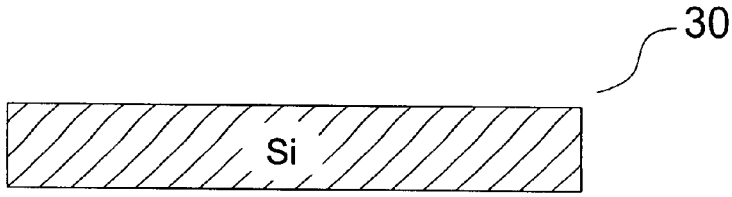
FIGS. 3(A)–3(F) show the result of various steps in the production of a cavity plate used in the ink jet head shown in FIG. 1.

First, as shown in FIG. 3(A), both sides of a (100) crystal plane orientation silicon substrate (wafer) are mirror polished to produce a silicon substrate 30 of a particular thickness, specifically 200 $\mu$m in this exemplary embodiment.

Figure 3B:
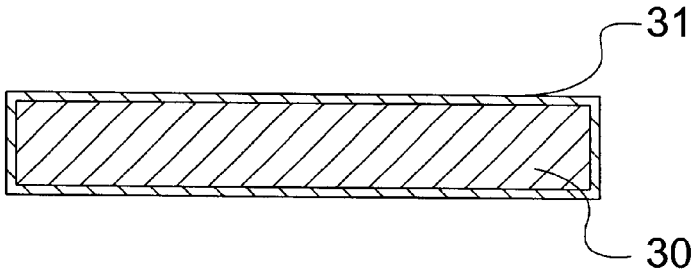

A wet oxidation process (mask formation process) is then applied to the silicon substrate 30 as shown in FIG. 3(B). That is, the silicon substrate 30 is heated to approximately 1050° C. in a wet environment, and this state is held for approximately 3 hours and 40 minutes to produce an approximately 1.3 $\mu$m thick thermal oxidation film ($SiO_2$) 31 on both surfaces of the silicon substrate 30. Note that by forming this thermal oxidation film 31 using a wet oxidation process, the film formation time can be shortened compared with forming an oxidation film of the same thickness using a dry oxidation process. The thermal oxidation film resulting from this wet oxidation process is used as the mask (etchant resistant material) for etching the silicon substrate 30.

Figure 3C:
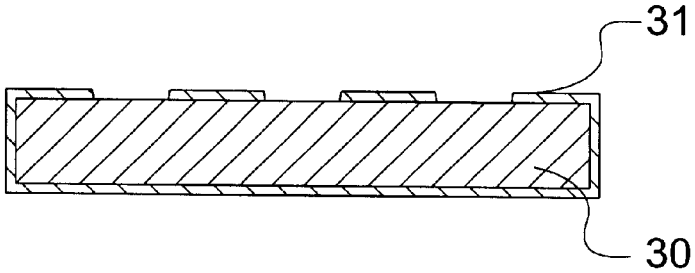

An etching process then follows. As shown in FIG. 3(C), a photoresist pattern (not shown in the figure) in the shape of the recesses to be formed as the ink chambers 6, ink supply opening 8, and ink reservoir 10 is formed on the thermal oxidation film 31 now covering the surface of the silicon substrate 30. A hydrofluoric acid etching solution is then used to remove part of the thermal oxidation film 31. The remaining photoresist pattern is then removed.

Figure 3D:
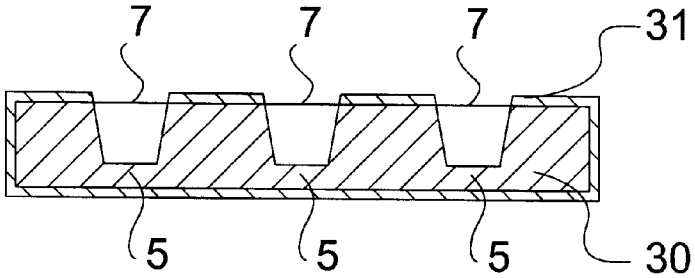

An etching step follows next as shown in FIG. 3(D). In this step, the exposed surface of the silicon substrate 30 is etched using an alkaline solution with the thermal oxidation film 31 remaining in a specific pattern functioning as a mask (etchant resistant material). This etching step forms the recesses 7 that will become the ink chambers 6, as well as the recesses that will become the ink supply openings 8 and ink reservoir 10, in the surface of the silicon substrate 30.

Figure 3E:
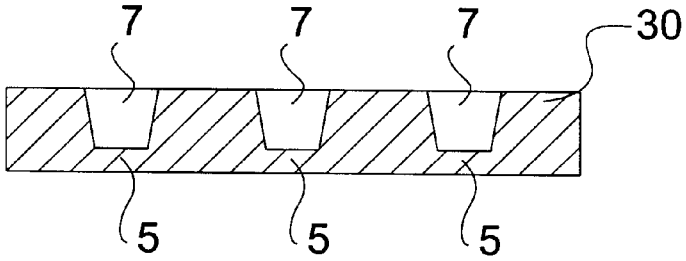

After forming the recesses, all of the thermal oxidation film 31 remaining on any side of the silicon substrate 30 is completely removed by etching with a hydrofluoric acid solution at an appropriate rate. The result of this oxidation film removing step is shown in FIG. 3(E). After this step, the thermal oxidation film 31 is completely removed, and the surface of the silicon substrate 30 is exposed.

Figure 3F:
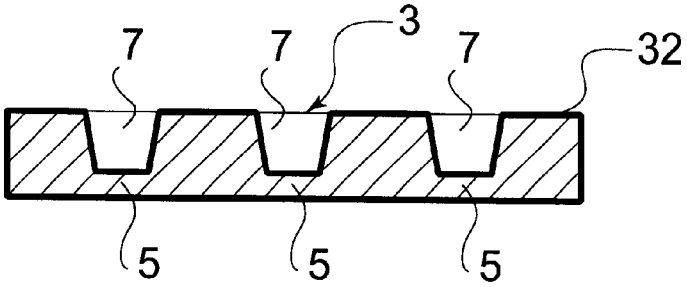

The silicon substrate 30 is then heated to approximately 1000° C. in a dry environment and held there for approximately 3 hours and 21 minutes to form a dry oxidation film 32 on the surface of the silicon substrate 30 as shown in FIG. 3(F). This is the protective film formation step of the present invention. This step results in the surface of the silicon substrate 30 being covered by an approximately 0.11 $\mu$m thick thermal oxidation film (protective film) 32.

The thermal oxidation film 32 formed by the protective film formation step is thus obtained by a dry oxidation process, and offers superior quality compared with the thermal oxidation film formed by wet oxidation. The corrosion resistance of the silicon substrate 30 can also be assured by this thermal oxidation film 32 in the cavity plate 3 shown in FIG. 1 and FIG. 2.

Manufacturing the nozzle plate

A method of manufacturing the nozzle plate 2 is described next with reference to FIGS. 4(A)–4(D) which illustrate the steps in the nozzle plate manufacturing process.

Figure 4A:
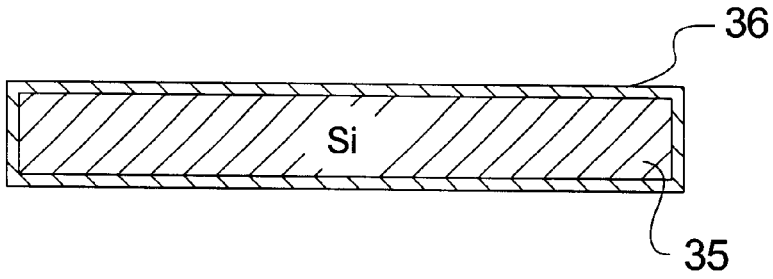
FIGS. 4(A)–4(D) show the result of various steps in the production of a nozzle plate used in the ink jet head shown in FIG. 1.

First, as shown in FIG. 4(A), both sides of a (100) crystal plane orientation p-silicon substrate 35 are mirror polished. A wet oxidation process (second mask formation process) is then applied to the silicon substrate 35 as shown in FIG. 4(A). That is, the silicon substrate 35 is heated to approximately 1075° C. in a wet environment, and this state is held for approximately 6 hours to produce an approximately 1.8

μm thick thermal oxidation film ($SiO_2$) 36 on both surfaces of the silicon substrate 35. Note that by forming this thermal oxidation film 36 using a wet oxidation process, the film formation time can be shortened compared with forming an oxidation film of the same thickness using a dry oxidation process. The thermal oxidation film 36 resulting from this wet oxidation process is used as the mask (etchant resistant material) for etching the silicon substrate 35.

Figure 4B:
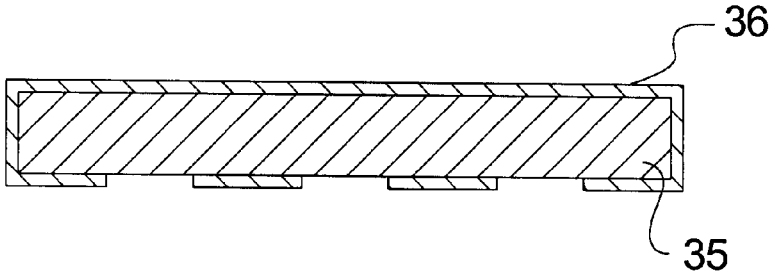

An etching process then follows. As shown in FIG. 4(B), a photoresist pattern (not shown in the figure) in the shape of the ink nozzles 21 and ink supply opening 12 is formed on the thermal oxidation film 36 now covering the surface of the silicon substrate 35. A hydrofluoric acid etching solution is then used to remove part of the thermal oxidation film 36. The remaining photoresist pattern is then removed.

An etching step (the second etching step of the present invention) follows next. In this step, the exposed surface of the silicon substrate 35 is etched using an alkaline solution with the thermal oxidation film 36 remaining in a specific pattern functioning as a mask (etchant resistant material). This etching step forms the plurality of ink nozzles 21 and ink supply opening 12 the surface of the silicon substrate 35.

Figure 4C:
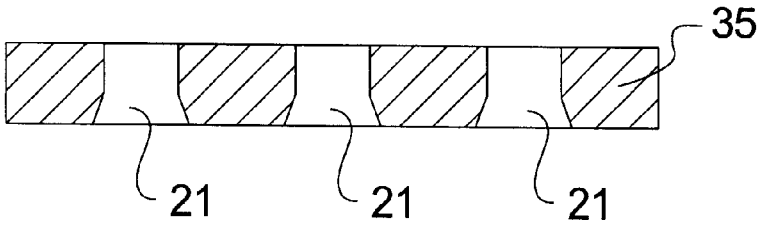

Following this second etching step, all of the thermal oxidation film 36 remaining on any side of the silicon substrate 35 is completely removed by etching with hydrofluoric acid at an appropriate rate. The result of this second oxidation film removing step is shown in FIG. 4(C). After this step, the thermal oxidation film 36 is completely removed, and the surface of the silicon substrate 35 is exposed.

Figure 4D:
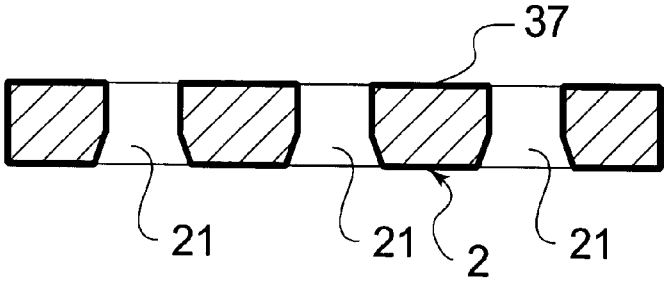

A second dry oxidation step (second protective film formation step) is then performed. In this step the silicon substrate 35 is heated to approximately 1000° C. in a dry environment and held there for approximately 3 hours and 35 minutes to form a dry oxidation film on the surfaces of the silicon substrate 35 as shown in FIG. 4(D). This step results in the surface of the silicon substrate 35 being covered by an approximately 0.11 μm thick thermal oxidation film (protective film) 37.

The thermal oxidation film 37 formed by this second protective film formation step is thus obtained by a dry oxidation process, and offers superior quality compared with the thermal oxidation film formed by wet oxidation. Note that this protective film is imparted to assure the ink resistance of the silicon substrate 35 of the nozzle plate 2 shown in FIG. 1 and FIG. 2.

The nozzle plate 2 thus obtained is then bonded to the surface on one side of the cavity plate 3 in a bonding step of the present invention. A glass substrate 4 on which the individual electrodes 17 are formed is then bonded to the other side of the cavity plate 3 in a second bonding step to form the ink jet head 1.

It should be noted that the thermal oxidation film used as an etching mask is formed by a wet oxidation process in the ink jet head manufacturing method according to the present embodiment. Because oxidation film growth is faster with wet oxidation than dry oxidation, the oxidation film can be formed in less time than if dry oxidation were used, and the productivity of ink jet head manufacturing can be improved.

In addition, the thermal oxidation films 37 and 32 formed at the final stage of the manufacturing process to protect the silicon nozzle plate 2 and cavity plate 3, respectively, from ink are produced using a dry oxidation process, which creates a high quality thermal oxidation film. Ink jet head durability can therefore be improved because the nozzle plate 2 and cavity plate 3 can be reliably protected by the thermal oxidation films 37 and 32 from corrosion and dissolution by ink.

The thermal oxidation films 32 and 37 formed by dry oxidation also have a dense film density, and therefore provide sufficient electrical isolation to eliminate damage to diaphragm 5 resulting from electrostatic discharge between a diaphragm 5 and an individual electrode 17.

The thickness of the oxidation film can also be easily controlled by using dry oxidation. An oxidation film with a uniform film thickness can therefore be formed on the surface of each diaphragm 5, and a uniform electrostatic attraction force can be produced between a diaphragm 5 and an individual electrode 17.

It is therefore possible to cause ink drops of appropriately controlled volume to be ejected from the ink nozzles, and an ink jet head with outstanding printing characteristics can be achieved.

In addition, sufficient electrostatic force can be produced between a diaphragm 5 and an individual electrode 17 because a thin oxidation film with outstanding corrosion resistance and electrical isolation properties can be used as a protective film. Ink jet head design changes such as incorporating a high voltage drive circuit are therefore not necessary. Ink jet head size and power consumption can also be reduced.

It should be further noted that the ink jet head I of the above-described embodiment is a face ink jet type head in which ink drops are ejected from ink nozzles disposed on the top surface of the substrate. It will, however, be obvious to one with ordinary skill in the related art that the present invention can also be applied to an edge ink jet type head in which the ink drops are ejected from ink nozzles disposed along an edge of the substrates.

Furthermore, the present invention shall not be limited to electrostatically driven ink jet heads, and can obviously be adapted to other ink jet heads of other drive types.

Manufacturing a Silicon Substrate with Recesses

As described above, the nozzle plate 2 and cavity plate 3 are made by forming recesses for the diaphragm, ink nozzles, and other ink jet head elements in silicon substrates. It should also be obvious, however, that silicon substrates with such recesses have a wide range of applications.

As with the nozzle plate 2 and cavity plate 3 described above, a silicon substrate having recesses can be manufactured by forming a thermal oxidation film as a mask on a silicon substrate using a wet oxidation step (mask formation step), then etching the silicon substrate to form one or more recesses with this thermal oxidation film used as a mask (etching step), then removing the thermal oxidation film mask (mask removal step), and finally forming a protective thermal oxidation film by a dry oxidation process (protective film formation step).

Experiments by the inventor demonstrated that if the substrate is thermally oxidized to form a protective film before the oxidation film used as a mask has been sufficiently removed, the recesses will have a depressed shape in a silicon substrate in which the ratio between the compliance and the length of the recess (for example, the length of a long rectangularly shaped recess) is $3.3\times10^{(-19)}m^4/N$ or greater. This is due to residual thermal stress from the temperature change during thermal oxidation film formation in the oxidation film (mask) and the unoxidized area of the silicon substrate, and is due to the difference in the thermal expansion and contraction ratios of the oxidation film and the silicon materials.

In addition, if the ratio between compliance and the length of the recess is $0.64\times10^{(-19)}m^4/N$ or less, the force used to deflect the diaphragm by means of electrostatic attraction must be increased. This makes it necessary to take such undesirable corrective measures as increasing the drive voltage or shortening the distance between the diaphragm and opposing electrode.

The ratio between compliance and recess length can be controlled to within the above-noted ranges during recess formation by adjusting the thickness and thereby the width of the thin wall parts. That is, if the thin wall part is made thinner, the width is also narrowed. In this case, an etching stop layer is formed by diffusing boron ions into the thin wall part of the silicon prior to etching, thereby making it possible to control the final thickness with good precision.

By thus making the thin wall part thinner, the width of the thin wall part can be decreased commensurately. More specifically, a high density series of consecutive recesses can be formed, and a high density ink jet head for an ink jet printer featuring outstanding print quality can be provided. In fact, a silicon substrate having a protective layer formed by dry oxidation after forming recesses 108 $\mu$m wide with a thin wall thickness of 2 $\mu$m was employed in an ink jet head with outstanding ejection characteristics for use in a high resolution, 360-dpi ink jet printer.

When the width of the thin wall part can be increased, i.e. for use with a lower density ink jet head, the thickness thereof can be relatively thick. It is therefore not necessary to use such special processes as implanting boron ions in the silicon. By thus eliminating an implantation step, recesses can be formed more easily. In another test, a recess 365 $\mu$m wide with a 13 $\mu$m thick thin wall part was formed in a silicon substrate to which a protective film was then imparted by dry oxidation, and the resulting silicon substrate was used to produce and test an electrostatic actuator. This actuator exhibited outstanding electrostatic attraction characteristics and vibration characteristics.

To prevent deflection of these recesses, a thermal oxidation film formed on the silicon substrate is removed by etching at an appropriate rate in hydrofluoric acid, and completely removed. While the etching conditions vary according to, for example, the silicon substrate, the shape of the formed recesses, and application, the conditions for removing the thermal oxidation film in order to form the diaphragms of the above-noted ink jet head are as described below.

The substrate is immersed for at least approximately 20 minutes in hydrofluoric acid at 25° C. to remove the thermal oxidation film, and then rinsed in demineralized water to remove the hydrofluoric acid. Any residual water is then dried using IPA (isopropyl alcohol) vapor. The thickness of the thermal oxidation film is then measured to confirm that the thermal oxidation film has been completely removed. Note that the difference between this operation and diaphragm formation is the thermal oxidation film removal time. Because the thermal oxidation film used as the mask is thick during nozzle formation, the immersion time required to remove the film is longer than that required during diaphragm formation.

This difference is because the nozzles are formed in a (100) crystal plane orientation silicon substrate and the diaphragms are formed in a (110) crystal plane orientation silicon substrate in the present embodiment, and the optimum thickness of the thermal oxidation film used as the etching mask is therefore different for each substrate.

By performing the above oxidation film removal process, silicon substrates in which the recess compliance is within the above-noted range can be provided whether the recesses are formed in a (100) plane silicon substrate or in the (110) plane by anistropic etching of a (110) plane silicon substrate. It is therefore possible to increase the number of recesses per unit area, and processing resolution can be improved. This means that a desirable reduction in size can be achieved when using a (110) plane silicon substrate in particular.

It will be obvious to one with ordinary skill in the related art that while the present invention has been described above with reference to an electrostatic actuator using the force of electrostatic attraction, or an ink jet head, the present invention shall not be limited to devices using the force of electrostatic repulsion.

The present invention shall also not be limited to actuator type devices. For example, the present invention can be used in a pressure sensor for detecting the pressure on a thin membrane (thin wall part) by detecting a change in electrostatic capacitance between the thin membrane (thin wall part) of a silicon substrate and an opposing electrode.

Effects of the Invention

The present invention as described above makes it possible to improve both ink jet head durability and the productivity of ink jet head manufacturing. In addition, when applied to an electrostatically driven ink jet head, damage to opposing members by an electrostatic discharge between opposing members is inhibited. In addition, ink drops of an appropriately controlled volume can be ejected from the ink nozzles, thereby assuring good print quality. Furthermore, a sufficient electrostatic force can be produced between opposing members, and ink jet head size and power consumption can be reduced.

Moreover, it is also possible to provide a method for manufacturing a silicon substrate comprising recesses such as those of the silicon substrate having recesses for use in an ink jet head, and a silicon substrate obtained by this manufacturing method.

Although the present invention has been described in connection with the preferred embodiments thereof with reference to the accompanying drawings, it is to be noted that various changes and modifications will be apparent to those skilled in the art. Such changes and modifications are to be understood as included within the scope of the present invention as defined by the appended claims, unless they depart therefrom.

What is claimed is:

1. A method of manufacturing a silicon substrate with a recess, comprising steps of:

(a) oxidizing a silicon substrate in a wet environment to form a wet-oxidation film on the substrate as an etching mask for forming a recess;

(b) etching the recess into the silicon substrate using the etching mask formed in step (a);

(c) removing from the silicon substrate the wet-oxidation film formed in step (a) after step (b); and (d) oxidizing the silicon substrate in a dry environment after step (c) to form a dry-oxidation film on the substrate as a protective film.

2. A method of manufacturing an ink jet head having a diaphragm for ejecting ink droplets, comprising steps of:

(a) oxidizing a silicon substrate in a wet environment to form a wet-oxidation film on the substrate as an etching mask for forming a diaphragm;

(b) etching the diaphragm into the silicon substrate using the etching mask formed in step (a);

(c) removing from the silicon substrate the wet-oxidation film formed in step (a) after step (b);

(d) oxidizing the silicon substrate in a dry environment after step (c) to form a dry-oxidation film on the substrate as a protective film; and (e) bonding a second substrate to the silicon substrate after the step (d) to form an ink chamber, the diaphragm forming a wall of the ink chamber.

3. The ink jet head manufacturing method according to claim 2, wherein the second substrate is a silicon substrate, and the method further comprises steps of:

(f) oxidizing the second substrate in a wet environment to form a wet-oxidation film on the second substrate as an etching mask for forming a nozzle;

(g) etching the nozzle into the second substrate using the etching mask formed in step (f);

(h) removing from the silicon substrate the wet-oxidation film formed in step (f) after step (g);

(i) oxidizing the second substrate in a dry environment after step (h) to form a dry-oxidation film on the second substrate as a protective film.

4. The ink jet head manufacturing method according to claim 2, further comprising steps of:

(f) providing a third substrate having an electrode; and (g) bonding the third substrate to the silicon substrate with the diaphragm opposed to the electrode with a specific gap therebetween.

5. A method of manufacturing a nozzle plate having a nozzle for ejecting ink droplets, comprising steps of:

(a) oxidizing a silicon substrate in a wet environment to form a wet-oxidation film on the silicon substrate as an etching mask for forming a nozzle;

(b) etching the nozzle into the silicon substrate using the etching mask formed in step (a);

(c) removing from the silicon substrate the wet-oxidation film formed in step (a) after step (b);

(d) oxidizing the silicon substrate in a dry environment after step (c) to form a dry-oxidation film on the silicon substrate as a protective film.

6. A silicon substrate comprising:

at least one recess, and wherein a ratio of compliance of said at least one recess to length of said at least one recess is at least $0.64\times10^{(-19)}m^4/N$ and at most $3.3\times10^{(-19)}m^4/N$.

7. An ink jet head comprising;

a silicon substrate having a diaphragm for ejecting ink;

an ink chamber formed in the silicon substrate, wherein said diaphragm forms a wall of the ink chamber;

a nozzle in connection with the ink chamber; and an electrode disposed opposite the diaphragm with a gap therebetween to displace the diaphragm by electrostatic force; and wherein a ratio of diaphragm compliance to diaphragm length is at least $0.64\times10^{(-19)}m^4/N$ and at most $3.3\times10^{(-19)}m^4/N$.

* * * * *